US005626952A

United States Patent [19]

McAbee et al.

[11] Patent Number: 5,626,952

[45] Date of Patent: May 6, 1997

[54] PROCESS FOR SIZING SPUN YARNS

[75] Inventors: Michael L. McAbee, Cataula; Warren S. Perkins, Watkinsville; Donald H. Shomake, Buford, all of Ga.

[73] Assignee: Callaway Corporation, Columbus, Ga.

[21] Appl. No.: 573,059

[22] Filed: Dec. 15, 1995

[51] Int. Cl.[6] ..... B32B 7/00

[52] U.S. Cl. ..... 442/154; 8/495; 427/389.9; 427/392; 427/401; 524/831; 442/187

[58] Field of Search ..... 427/389.9, 392, 427/401; 428/290, 264, 265, 270; 524/831; 8/495

[56] References Cited

U.S. PATENT DOCUMENTS

| | | | |
|---|---|---|---|
| 4,515,855 | 5/1985 | Ling | 428/290 |
| 5,264,251 | 11/1993 | Geursen et al. | 427/389.9 |
| 5,397,633 | 3/1995 | McAbee et al. | 427/389.9 X |

*Primary Examiner*—Michael Lusignan
*Attorney, Agent, or Firm*—Bruce F. Jacobs; Diderico Van Eyl

[57] ABSTRACT

A process for sizing spun yarns by adding urea in an amount of about 10 to 50% by weight of the weight of a polyacrylamide polymer, wherein the polymer and urea are applied in an amount sufficient to impart a high order of abrasion resistance to the yarn.

21 Claims, No Drawings

PROCESS FOR SIZING SPUN YARNS

FIELD OF THE INVENTION

This invention is directed to the sizing of spun yarns, particularly spun cotton yarns by treatment of the yarns prior to weaving with a combination of a low molecular weight polyacrylamide solution-polymerized polymer and urea.

BACKGROUND OF THE INVENTION

The use of various compounds as sizing agents for warp yarns to prevent breakage of the yarns during weaving is well known. The sizing agents are placed upon the warp yarns prior to weaving to provide strength and protection to the yarns from abrasion. Traditional sizing agents for spun yarns have generally included film formers such as starch, starch derivatives, polyvinyl alcohol, polyester resins, waxes, acrylic polymers and copolymers (and their salts), wetting agents, antistatic agents, and the like. Current commercial sizes are predominantly based upon starch in combination with one or more of polyvinyl alcohol, polyester resins, acrylic copolymer resins, and waxes.

A good sizing agent is one which will form a film with sufficient strength to provide protection to the yarn being sized but not so strong that the yarn will break before the size film. This is particularly important as yarns are generally sized in a size box, then the water removed on steam cans and the yarns form a sheet. Then this sheet of yarns is run across bust rods to break the sheet back into individual yarns for weaving.

Most previous attempts to utilize polyacrylamide homopolymers as sizing agents have not been successful. For example, U.S. Pat. No. 4,515,855 claims the use of acrylamide copolymers and multipolymers with at least one monomeric compound containing a hydrophobic polymerizable reactive vinyl or vinylidene group but asserts that homopolymers of acrylamide impart only minor protection to fibers during weaving. Example 11 pads a polyacrylamide polymer solution unto single-end 100% untreated yarns. No indication of the type of polyacrylamide polymer nor its molecular weight are provided. Evaluation of the polyacrylamide padded yarns indicate little difference in performance vs. starch alone and substantially inferior performance as compared to the claimed copolymers and multipolymers. U.S. Pat. No. 4,410,588 contains a similar statement on acrylamide homopolymers but also contains no details thereon.

Commonly owned U.S. Patent No 5,397,633 discloses a process of sizing a spun cotton yarn with a solution polyacrylamide polymer. The present invention is an improvement thereover.

Since prior sizing agents have not been completely adequate for use in processing spun yarns, it is an object of the present invention to overcome certain of the deficiencies of the prior sizes, particularly in the processing of spun yarns, e.g. blends of cotton with polyester, acrylic yarns, and blends of wool with other fibers. More particularly, it is an object of the present invention to overcome certain of the deficiencies when such yarns are to be overdyed.

Furthermore, with the increasing levels of both general environmental concern and garment processing in the denim industry, e.g. stone washing, pre-washing, and the like, it is a further object of the present invention to develop a sizing agent which will be less harmful to the environment than conventional size materials, i.e. one which has a reduced biological oxygen demand (BOD) and chemical oxygen demand (COD).

It is also an object to develop a size composition that is sufficiently water soluble that it can be easily and completely washed from a fabric after weaving, thereby (i) preventing dye defects, (ii) preventing microbial growth due to incomplete removal of the size (as often occurs with conventional sizes), and (iii) saving energy.

It is a still further object of the invention to develop an effective non-ionic sizing agent which will permit the utilization of cationic fixing agents such as polyamine and polyamide polymers.

It is still a further object to develop a size that will not produce "crack" or crease marks on fabrics made of spun yarns, especially on yarn-dyed fabric in garment processing.

It is still a further object of the invention to develop a sizing agent which does not become tacky or sticky in the presence of the very high moisture levels commonly present in weaving rooms.

These and still further objects will be apparent from the following detailed description of the invention.

SUMMARY OF THE INVENTION

The present invention is directed to an improvement in a process for sizing spun yarns which (1)applies an aqueous solution comprising a solution polymerized polyacrylamide polymer which has a viscosity of about 400 to 900 cps at 20% solids to a yarn substrate and (2) dries the treated substrate. The present invention improves upon this process by adding urea to the polymer solution to form a mixed solution prior to the applying, wherein the urea is added in an amount of about 10 to 50% by weight of the weight of the polyacrylamide polymer and wherein the polymer and urea are applied in an amount sufficient to impart: a high order of abrasion resistance to the yarn while being capable of being removed from the yarn by aqueous washing. More preferably, the polymer and urea are applied in an amount sufficient to increase the weaving efficiency of the yarn substrate by at least about 3%, as compared to a conventional starch sizing agent composition.

When the spun yarn substrate is a dyed cotton spun yarn, a suitable amount of the solution polyacrylamide polymer is generally from about 2 to about 15 wt % based on the weight of the yarn. When the spun yarn substrates are cotton towel pile yarns, a suitable amount of the solution polyacrylamide polymer is about 1 to about 5 wt % and a suitable amount of urea is about 10 to 50 wt % of the polyacrylamide polymer. Botch insufficient and excessive amounts of size have been found to reduce the weaving efficiency to below the level obtained by following the present invention.

As a result of the invention, weaving efficiency can be substantially increased while simultaneously reducing the total amount of sizing agent required. This economical treatment produces a sized yarn which is more environmentally friendly than previous sized yarns and results in fabrics having very low BOD and reduced COD values compared to conventional size.

DESCRIPTION OF THE PREFERRED EMBODIMENTS

The present invention is directed to an improvement in a process for sizing spun yarns which (1) applies an aqueous solution comprising a solution polymerized polyacrylamide polymer which has a viscosity of about 400 to 900 cps at 20% solids to a yarn substrate and (2) dries the treated substrate. The present invention improves upon this process by adding urea to the polymer solution to form a mixed solution prior to the applying, wherein the urea is added in an amount of about 10 to 50% by weight of the weight of the polyacrylamide polymer and wherein the polymer and urea are applied in an amount sufficient to impart a high order of abrasion resistance to the yarn while being capable of being removed from the yarn by aqueous washing. More preferably, the polymer and urea are applied in an amount sufficient to increase the weaving efficiency of the yarn substrate by at least about 3 %, as compared to a conventional starch sizing agent composition.

When the spun yarn substrate is a dyed cotton spun yarn, a suitable amount of the solution polyacrylamide polymer is generally from about 2 to about 15 wt % based on the weight of the yarn. When the spun yarn substrates are cotton towel pile yarns, a suitable amount of the solution polyacrylamide polymer is preferably about 1 to about 5 wt % and a suitable amount of urea is about 10 to 50 wt % of the polyacrylamide polymer. Both insufficient and excessive amounts of size have been found to reduce the weaving efficiency to below the level obtained by following the present invention.

As a result of the invention, weaving efficiency can be substantially increased while simultaneously reducing the total amount of sizing agent required. This economical treatment produces a sized yarn which is more environmentally friendly than previous sized yarns and results in fabrics having very low BOD and reduced COD values compared to conventional size.

Suitable polyacrylamide polymers are homopolymers produced by a solution polymerization procedure, as opposed to a bulk or suspension or emulsion or inverse emulsion polymerization technique. The solution polymerized polyacrylamide homopolymers generally have a low molecular weight as evidenced by a viscosity of a 20 wt % aqueous solution thereof being only about 400 to about 900 cps, preferably about 500 to about 800 cps, as determined by a Brookfield RVT Viscometer at 25° C. using spindle #3 at 50 RPM. It is believed that this viscosity corresponds to a molecular weight in the range of about 30,000 to about 180,000 daltons. Care should be taken to prevent hydrolysis of the polyacrylamide polymer since the presence of acid groups has been found to be deleterious to the performance of the sizing agent, particularly in the high moisture levels commonly found in weaving rooms to facilitate the weaving process.

Any conventional acrylamide solution polymerization technique may be used to prepare the solution polyacrylamide polymers used herein. Generally, acrylamide monomers are polymerized in an aqueous medium, under an inert atmosphere, and in the presence of a catalytic amount of a free-radical source such as ammonium persulfate, sodium bisulfite, and the like. The reaction mixture is stirred under the inert atmosphere until the polymerization is complete. The resulting product is a slightly viscous solution which, depending upon its solids content, may be directly used in the present invention or may be diluted to a lower solids level. A particularly suitable polyacrylamide polymer is available from Callaway Chemical Company, Columbus, Ga., as Callaway 4600.

The aqueous polymer-urea solution may be prepared by simply dissolving the urea in the solution polyacrylamide polymer and mixing until a homogeneous solution is formed. The polyacrylamide polymer/urea mixture generally contains about 1 to about 25% by weight of a combination of the polyacrylamide polymer and the urea, wherein the urea is present in an amount of about 10 to 50% by weight of the polyacrylamide polymer. Preferably the amount of the urea is about 20 to 40, and most preferably about 25 wt %, all by weight based on the weight of the polyacrylamide polymer. A suitable composition of a solution polyacrylamide and urea is available from Callaway Chemical Company as Callaway 1640, a mixture of Callaway 4600 and urea having a 4/1 ratio of Callaway 4600/urea, on a solids basis.

Preferably, the spun yarns are sized with such a simple aqueous mixture of polyacrylamide solution polymer and urea. Although not currently preferred, additives may be added to the polyacrylamide solution polymer/urea mixture. Starch, for example, although reducing the effectiveness of the size composition may be added in an amount from about 5 to about 95 wt % by weight of the polyacrylamide polymer to impart increased fabric stiffness. Similarly, wax is undesirable because it is not readily soluble in the aqueous solution and requires that the size solution be utilized at more elevated temperatures to keep the wax in solution. Nevertheless, it may be added in an amount from about 1 to about 15 wt %, based on the weight of the polyacrylamide polymer.

Viscosity builders, such as sodium alginate or hydroxyethyl cellulose, may be added depending upon the specific equipment being utilized. Although not preferred, a modifier such as polyvinyl alcohol may be added to the size composition to increase viscosity and modify film properties. The amount of polyvinyl alcohol may be from about 1 to about 25 wt %. Similarly, other conventional sizing additives, such as binders, lubricants, plasticizers, stabilizers, and the like, may be used singly or in combination. Binders can be added in amounts from about 5 to about 25 wt %, while lubricants and plasticizers can be added in amounts from about 1 to about 25 wt % each, both based on the weight of the polyacrylamide polymer. Also, release agents to prevent the composition from adhering to non-Teflon®-coated equipment may be used in an amount of about 1 to about 5 wt %. Lecithin is a currently preferred release agent.

The solution polyacrylamide polymer and urea are applied to spun yarns in amounts sufficient to impart a high order of abrasion resistance to the yarn while still being removable from the yarn after weaving by aqueous washing. Preferably the polymer/urea solution is used in an amount sufficient to increase the weaving efficiency of the yarn substrate by at least about 3 % as compared to a conventional starch sizing agent, and at least about 1% as compared to polymer solutions prepared with a solution polyacrylamide polymer alone, i.e. in the absence of urea. These weaving efficiencies are determined by averaging the weaving efficiency of a number of looms preparing the same type product at the time a mill trial is performed with the sizing agents. Generally, the conventional starch sizing agents include starch in combination with one or more of polyvinyl alcohol, acrylic binders, waxes, acrylic copolymers, and the like.

The amount of the solution polyacrylamide polymer in the solution polyacrylamide polymer/urea mixture varies, and may be affected by factors such as the type of spun yarn being treated. When the spun yarn substrate is a dyed spun yarn, the amount of a suitable add-on of the solution polyacrylamide polymer is in the range of from about 2 to about 15 wt %, based on the weight of the yarn. When the yarn has been dyed prior to sizing, the amount of the solution polymerized polyacrylamide polymer is about 3 to 12 %, based on the weight of the yarn. When the spun yarn substrate is undyed towel pile yarns, a suitable such amount is generally lower, i.e. in the range of from about 1 to 5 wt %, again based on the weight of the yarn. When the yarn is an undyed towel pile cotton yarn, the amount of the polyacrylamide polymer is preferably from about 1 to about 3 wt %, and the amount of the urea is from about 0.2 to about 0.6 wt %, both based upon the weight of the yarn. Insufficient amounts of the size composition will reduce the weaving efficiency. Excessive amounts of size may also reduce weaving efficiency.

The application of the solution polyacrylamide polymer and urea to the spun yarns may be accomplished by conventional padding, spraying, knife coating, and the like. Preferably, the urea and the polymer are applied in a mixed solution at a temperature in the range from about room temperature to about 212° F. (100° C.), preferably about 100°–135° F. (38°–57° C.). Although not preferred due to skin formation on the surface of the size solution in the size box, the polyacrylamide/urea sizing composition may be applied at temperatures up to about 212° F. (100° C.). Preferably, the yarn is beamed on a reel and run through a size box and squeeze rollers are set to deposit the desired level of sizing agent solids. Thereafter, the treated yarns are dried, routinely by heating for a period of time on steam cans. The resulting yarns are in the form of a sheet which is run across bust rods to break the yarn sheet back into individual yarns for weaving.

Suitable yarns for use herein are spun yarns containing cotton, polyester, acrylic, wool and/or rayon fibers. These yarns include ring, open-end, and air-jet spun yarns. The spun yarns may be of a single fiber type or a blend of two or more fibers. Two-ply acrylic yarns are preferred acrylic yarns.

The process of this invention produces a size coating on spun yarns which can be easily removed in subsequent washing. More particularly, the effluent from that washing is far less detrimental to the environment than starch base commercial sizing products. The approximate biological oxygen demand and chemical oxygen demand for the solution polyacrylamide homopolymers used herein vs. starch is as follows:

TABLE I

| Sizing agent | BOD (mg/l) | COD (mg/l) |
|---|---|---|
| Solution polyacrylamide/urea | 20,000 | 160,000–421,000 |
| Starch | 650,000 | 1,500,000 |

The treated textile substrates are further characterized by generally requiring less total sizing agent than is currently commercially used. For example, with traditional size formulations used with a dyed yarn, about 9 to about 16 wt % size add on is commonly used to give a sufficient degree of protection during weaving. Superior results in actual field trials with the size composition of the present invention have been obtained at only 3 to 4 wt % solution polyacrylamide polymer and 0.5 to 1 wt % of urea. Similarly, with traditional size formulations used with undyed towel pile yarn, about 3 to about 5 wt % size is commonly used while the present invention can reduce the amount of size composition to about 1.25 to 2.5 wt %. And with polyester blends and rayon blends, the conventional 10–15% size loading can be reduced to about 9–12% with the present size solution. When the yarn is a two-ply acrylic yarn, about 1–3% size add on of the polyacrylamide/urea size composition significantly improves weaving performance of the yarn. In conventional manufacturing, 2-ply acrylic yarns are currently not normally sized before weaving.

When the spun yarn substrate has been pre-dyed, as is common in denim processing, both the fabric produced after weaving and the garments produced therefrom can be directly overdyed without the need for prior removal of the sizing agent. Of course, the size may be removed prior to overdyeing if desired.

The following examples are illustrative of the process of the present invention and not in limitation thereof. All parts and percents are by weight unless otherwise specified.

EXAMPLE 1

A suitable polymer/urea sizing solution was prepared. To prepare the polymer, 190.5 g of aqueous acrylamide (52.5% real solids) was added to 300.0 g water in a suitable reaction vessel with sufficient agitation to create a distinct vortex. Nitrogen sparging was begun and a solution of 0.36 g sodium hypophosphite in 5.1 g water was charged into the reaction vessel. The reaction mixture was heated slightly to a temperature of 23°26° C. and then the nitrogen was changed from a sparge to a blanket. 0.96 g of ammonium persulfate was added and within 20 seconds a premixed solution of 0.14 g sodium metabisulfite in 1.2 g water was also added. Thereafter, the reaction vessel was sealed off and the polymerization reaction occurred. Adequate cooling was used to maintain the reaction temperature between 80 and 90° C. After the exotherm subsided, a solution of 0.02 g sodium metabisulfite in 0.25 g water was added, the cooling was turned off, and the reaction mixture held for 45 minutes. After cooling to 50°–55° C., the pH was adjusted to 5–7 with caustic soda and the solution diluted to 20 wt % solids. The resulting dilute polymer solution had a viscosity of 650 centipoise as determined by Brookfield RVT Viscometer, spindle no. 3, 50 RPM, 25° C.

25 g of urea was dissolved in the polymer solution and mixed to make a substantially homogenous mixture of polyacrylamide and urea. Mixing of urea was done in the reaction vessel at 50°–55° C.

EXAMPLE 2

Following the procedures of Example 1, sizing formulations were prepared from polyacrylamide polymer containing 0, 5, 10, 25, and 50 wt % urea, based upon the weight of the polyacrylamide. Films were cast from these formulations and screened for flexibility, toughness, and adhesion to polyester and cellulose. Based on these studies, the sizing formulation containing 25 wt % of urea was chosen for application to yarn.

A warp consisting of 50 yarns 1.75 inches in width, and 25 yards in length, was used. The squeeze pressure was 15 psig, and the slasher speed was generally 10–15 ypm, as required for moisture control. Four (4) drying cylinders at a temperature of about 250° C. were used. The first 2 cylinders were Teflon®-coated cylinders. Undyed open-end yarn (6's), 100 % cotton, yarn was passed through the size box and then was squeezed with rollers. The following tests were performed on yarns treated with the various add-ons of the size material: (i) abrasion resistance, (ii) strength and (iii) elongation. Yarn tests were performed on samples that had been conditioned for a minimum of four (4) hours at standard textile conditions (relative humidity of 65% at 70° F. (21° C.)).

Abrasion Resistance

The abrasion resistance of treated yarns was determined by a Sulzer-Ruti Web-tester, which simulates weaving conditions by tensioning 15 yarn specimens to a predetermined level and cyclically abrading the yarn against metal pins. The number of abrasive cycles required to break each yarn or cause formation of a fuzz ball on the yarn was determined.

Abrasive performance of the yarn was visually evaluated after 500 and 1200 abrasive cycles. Yarn breakage, formation of fuzz balls, and appearance of hairiness of the treated yarns were evaluated. Generally, samples forming two or more fuzz balls during 1200 abrasive cycles were rated as failures. All of the abraded samples were mounted and were available for inspections.

Abrasion resistance of finer (higher counts) yarns was measured on a Zweigle abrader which rubs yarn (held at a constant tension) against standard abrasive paper until the yarn breaks. The number of abrasive cycles required to break the yarn was determined.

Strength and Elongation

For evaluating the effect of the sizing agents on the strength and elongation of the yarns, an Instron Tensile Tester was used, wherein the test consisted of breaking 25 individual yarn specimens that were randomly selected from the warp sheet.

Film Studies

Films were cast to assess the effect of various additives on properties of the polyacrylamide polymer and to compare Callaway 4600 to other size materials. The films were prepared by pouring 100 grams of formulation on a Teflon® coated pan and evaporating the solution to dryness in an oven at 200° F. (93° C.).

Adhesion Studies

Adhesion to polyester (mylar) and cellulose (cellophane) was tested by placing droplets of the various size solutions on sheets of these two materials and letting them dry in ambient air.

The results of the tests showed that the addition of urea to the polyacrylamide polymer dramatically improved performance of the polymer as a warp size. The addition of urea improved abrasion resistance, elongation, and strength of yarns sized as compared with formulations without urea. Film studies showed that the polymer/urea sizing formulations formed films with sufficient strength to provide protection to the yarn being sized but not so strong that the yarn would break before the size film. Thus, the compositions make good sizing agents. The toughness and flexibility of the films is believed to be responsible for the excellent strength, extensibility and abrasive performance of yarns sized with the compositions of the present invention. Adhesion studies showed that the polyacrylamide/urea sizing formulations adhered better to both polyester (Mylar) and cellulose (Cellophane) than did the polyacrylamide polymer alone.

EXAMPLE 3

The procedure of Example 2 was repeated except that the polyacrylamide polymer/urea solution (80/20, solids basis) was further mixed with starch in the following ratios: 50/50, 25/75, 10/90.

The performance of the polyacrylamide polymer/urea/starch blend in abrasion resistance improved slightly with higher ratio of polyacrylamide polymer solution/urea to starch. The polyacrylamide/urea solution performed better than polymer/urea solution and starch blends in all cases for a given size add on. This suggests that the starch was detrimental to the performance of the polyacrylamide polymer/urea size solution.

EXAMPLE 4

A field trial of the process of the present invention was performed by mixing 450 pounds of a solution polyacrylamide polymer-urea mixture (80/20 solids basis) prepared as described in Example 1 with 157 gallons of water and adding it to a size box. The size mix was not cooked but was heated to 130° F. (54° C.) in a size box during the application. Indigo blue dyed open-end yarn (6's), 100 cotton, 14 3/4 oz. fabric, was passed through the size box and then was squeezed with rollers to add on 5.1 wt % of the size material. After drying on steam cans, the resulting sheet of yarns was run across bust rods (slasher) to break the sheet back into individual yarns for weaving.

No problems occurred on the slasher and a weaving trial was performed. At the same time as the trial, the mill was running about 100 other looms of the same spun yarn which had been sized in accordance with the mill's conventional starch based sizing composition for this yarn. The conventional composition was a mixture of 300 pounds starch, 50 pounds wax, and 220 gallons water. The weaving efficiency of the loom utilizing the sizing agent of this invention was 95%, and the average weaving efficiency of the conventionally sized looms was about 91%. The weaving efficiency was determined by dividing the number of theoretical picks into the actual number of picks run (a pick occurs every time a filling yarn was inserted into the fabric). When a yarn breaks, the loom stops, reducing the number of picks run per unit time. Types of yarn breaks were characterized and counted to give a loom efficiency and also to determine the level of defects (breaks) which were warp-related and which are fill-related (fill yarn contained no size). Trials on 6's ring-spun indigo-dyed and sulfur-dyed yarns gave similar results to the above example.

EXAMPLE 5

The procedure of Example 2 was repeated except that (i) the yarn sized was 15's, 65/35 polyester/rayon 100% cotton ring spun yarn, (ii) 565 pounds of the 24 % polyacrylamide solution polymer-urea mixture was initially blended with 135 gallons of water; (iii) the size add on was 5.8 % and (iv) the size mix was heated to 135° F. (57° C.).

The results of a weaving trial in comparison with about 20 looms of conventionally starch-sized yarn composed of 250 pounds starch, 20 pounds polyvinyl alcohol, 20 pounds of flake wax, and 350 gallons water. The add-on was a standard 6 %. Yarn sized with the present invention withstood more than 1500 abrasive cycles while the conventional yarn withstood only 733 cycles.

EXAMPLE 6

The procedure of Example 5 was repeated except that (i) the yarn sized was 18's 60/40 rayon/wool, (ii) 1130 pounds of the 24 % polyacrylamide polymer/urea solution was initially blended with 73 gallons of water, and (iii) the polyacrylamide solution polymer add on was 9 % and the urea add on was 2%.

The results of a weaving trial in comparison with 100 looms of conventionally sized yarn composed of 500 pounds of polyvinyl alcohol, 80 pounds acrylic emulsion polymer, 80 pounds of wax, and 320 gallons of water, showed that the weaving efficiency of the yarn treated in accordance with the present invention was equal to or superior to the conventionally-sized yarns. The yarn sized in accordance with the present invention also withstood 201 abrasive cycles, compared to only 193 abrasive cycles for yarns sized with conventional formulations.

What is claimed is:

1. In the sizing of a spun yarn by performing the steps of: (1) applying to a yarn substrate an aqueous solution comprising a solution polymerized polyacrylamide polymer which has a viscosity of about 400 to 900 cps at 20% solids and (2) drying the treated substrate, the improvement comprising adding urea to the polymer solution to form a mixed solution and applying the mixed solution, wherein the urea is added in an amount of about 10 to 50% by weight of the weight of the polyacrylamide polymer and wherein the polymer and urea are applied in an amount sufficient to impart a high order of abrasion resistance to the yarn while being capable of being removed from the yarn by aqueous washing.

2. The process of claim 1, wherein the amount of the polymer and the amount of the urea are sufficient to improve the weaving efficiency of the yarn substrate by at least about 3% as compared to a conventional starch size composition.

3. The process of claim 1, wherein the amount of the polymer and the amount of the urea are sufficient to improve the weaving efficiency of the yarn substrate by at least about 1% as compared to a polyacrylamide size composition in the absence of the urea.

4. The process of claim 1, wherein the mixed solution contains from about 1 to about 25% by weight of the polyacrylamide polymer and the urea.

5. The process of claim 3, wherein the yarn substrate polymer is selected from the group consisting of cotton, polyester, acrylic, wool, rayon and blends thereof.

6. The process of claim 5, wherein the yarn is a two-ply acrylic yarn.

7. The process of claim 1, wherein the spun yarn substrate is a dyed cotton spun yarn, and a suitable amount of the solution polyacrylamide polymer is from about 2 to about 15 wt % based on the weight of the yarn.

8. The process of claim 1, wherein the spun yarn substrate is a cotton towel pile yarn, and a suitable amount of the solution polyacrylamide polymer is about 1 to about 5 wt %, based on the weight of the yarn.

9. The process of claim 1, wherein the yarn has been dyed prior to sizing and the amount of the solution polymerized polyacrylamide polymer is about 3 to 12 %, based on the weight of the yarn.

10. The process of claim 9, wherein after the dyed yarn is sized, it is further processed by the steps of weaving it into a fabric and then overdyeing without removal of the solution polyacrylamide polymer and the urea.

11. The process of claim 1, wherein the yarn is an undyed towel pile cotton yarn and the amount of the polyacrylamide polymer is from about 1 to about 3 wt %, and the amount of the urea is from about 0.2 to about 0.6 wt %, based upon the weight of the yarn.

12. The process of claim is wherein the spun yarn is selected from the group consisting of ring spun, open-end, and air-jet yarns.

13. The process of claim 1, wherein the viscosity of the polyacrylamide polymer is from about 500 to 800 centipoise.

14. The process of claim 1, wherein the solution of urea and polyacrylamide is applied to the substrate at a temperature of from about room temperature to about 212° F.

15. The process of claim 1, wherein an additive selected from the group consisting of stiffeners, viscosity modifiers, binders, lubricants, plasticizers, release agents, and stabilizers is further added to the polymer solution.

16. The process of claim 15, wherein prior to use, starch is added to the polyacrylamide polymer-urea solution in an amount of from about 5 to about 95 wt % based upon the weight of the polyacrylamide.

17. The process of claim 15, wherein prior to use, polyvinyl alcohol is added to the polyacrylamide polymer-urea solution in an amount of from about 1 to about 25 wt % based upon the weight of the polyacrylamide.

18. The process of claim 15, wherein prior to use, a wax is added to the polyacrylamide polymer-urea solution in an amount of from about 1 to about 15 wt % based upon the weight of the polyacrylamide.

19. The process of claim 15, wherein prior to use, lecithin is added to the polyacrylamide polymer-urea solution in an amount of from about 1 to about 5 wt % based upon the weight of the polyacrylamide.

20. The treated yarn produced by the process of claim 1.

21. The overdyed woven fabric produced by the process of claim 10.

* * * * *